United States Patent [19]

Tosun et al.

[11] Patent Number: 4,979,985

[45] Date of Patent: Dec. 25, 1990

[54] PROCESS FOR MAKING FINELY DIVIDED PARTICLES OF SILVER METAL

[75] Inventors: Guray Tosun; Howard D. Glicksman, both of Wilmington, Del.

[73] Assignee: E. I. Du Pont de Nemours and Company, Wilmington, Del.

[21] Appl. No.: 475,927

[22] Filed: Feb. 6, 1990

[51] Int. Cl.[5] ..... C22B 3/00; B22F 7/00

[52] U.S. Cl. ..... 75/370; 75/371; 75/741; 106/1.19

[58] Field of Search ..... 106/1.19; 75/0.5 A, 75/109, 370, 741, 371

[56] References Cited

U.S. PATENT DOCUMENTS

| | | | |
|---|---|---|---|
| 3,201,223 | 8/1965 | Cuhra et al. | 75/370 |
| 3,345,158 | 10/1967 | Block et al. | 75/371 |
| 4,094,811 | 6/1978 | Botta et al. | 106/1.19 |
| 4,371,459 | 2/1983 | Nazarenko | 106/1.19 |

*Primary Examiner*—Theodore Morris
*Assistant Examiner*—Robert R. Koehler

[57] ABSTRACT

A reductive process for making finely divided silver particles in which the silver particles are precipitated from an aqueous acidic solution of silver salt, gelatin and alkyl acid phosphate.

9 Claims, No Drawings

PROCESS FOR MAKING FINELY DIVIDED PARTICLES OF SILVER METAL

FIELD OF INVENTION

The invention is directed to an improved process for making finely divided silver particles. In particular, the invention is directed to a process for making silver particles with a narrow particle size distribution.

BACKGROUND OF THE INVENTION

Silver powder is widely used in the electronics industry for the manufacture of conductor thick film pastes. These thick film pastes are used to form conductive circuit patterns which are applied to substrates by screen printing. These circuits are then dried and fired to volatilize the liquid organic vehicle and to sinter the silver particles to form the conductor circuit pattern.

Printed circuit technology is requiring denser and more precise electronic circuits. To meet these requirements, the conductive lines have become more narrow in width with smaller distances between lines. The silver powders necessary to form more closely packed, narrower lines must be as close as possible to spherical in shape with narrow particle size distributions.

Many methods currently used to manufacture metal powders can be applied to the production of silver powders. For example, chemical methods, physical processes such as atomization or milling, thermal decomposition, and electro-chemical processes can be used.

Silver powders used in electronic applications are generally manufactured using chemical precipitation processes. Silver powder is produced by chemical reduction in which an aqueous solution of a soluble salt of silver is reacted with an appropriate reducing agent under conditions such that silver powder can be precipitated. The most common silver salt used is silver nitrate. Inorganic reducing agents including hydrazine, sulfite salts, and formate salts can be used to reduce silver nitrate. These processes tend to produce powders which are very coarse in size (greater than 2 microns), are irregularly shaped and have a large particle size distribution due to aggregation.

Organic reducing agents such as alcohols, sugars, or aldehydes are used with alkali hydroxides to create the reducing conditions for silver nitrate. Under these conditions, the reduction reaction is very fast and hard to control and produces a powder with residual alkali ions. Although small in size (<1 micron), these powders tend to have an irregular shape with a wide distribution of particle sizes that do not pack well. These types of silver powders exhibit difficult-to-control sintering and inadequate line resolution in thick film printed conductor circuits.

SUMMARY OF THE INVENTION

The invention is therefore directed to a reductive process for making finely divided particles of metallic silver with narrow particle size distribution. In particular the invention is directed to a process for the preparation of finely divided particles of metallic silver comprising the sequential steps:

A. Forming a non-basic aqueous solution of a silver salt, a gelatin and an alkyl acid phosphate corresponding to the structural formula:

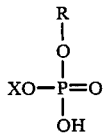

wherein X is independently selected from H and R groups and R is a $C_{6-20}$ alkyl group, which optionally may contain up to 10 ethylene oxide (EO) moieties, the solution comprising at least 0.2 mole per liter of dissolved silver salt, from 0.001 to 0.02 gram of gelatin per gram of metallic silver and from 0.1 to 0.5 gram of alkyl acid phosphate per liter of initial solution.

B. Admixing into the reactant solution from step A a stoichiometric excess of a water-soluble formate to effect complete reduction of the silver salt by which discrete particles of metallic silver are precipitated with the concomitant formation of $CO_2$ and $HNO_3$, while maintaining the reaction solution under agitation at a rate sufficient to keep the precipitated particles dispersed until the reduction reaction is completed, but sufficiently low to avoid foaming of the reaction dispersion;

C. Separating the silver particles from the liquid components of the reaction solution;

D. Washing the separated silver particles with deionized water to remove adsorbed materials therefrom; and E. Drying the washed silver particles to remove the water therefrom.

PRIOR ART

U.S. Pat. No. 2,752,237, Short

The Short patent is directed to a process for making silver by precipitating $Ag_2CO_3$ from an aqueous $AgNO_3$ solution containing a small residual amount of $HNO_3$ using an excess of alkali metal salt. The basic $Ag_2CO_3$ suspension is then reduced with a reducing agent such as formaldehyde.

U.S. Pat. No. 3,201,223, Cuhra et al

The reference is directed to a method for making small silver particles by precipitation of $Ag_2O$ from $AgNO_3$ solution by adding alkali hydroxide, (2) converting the $Ag_2O$ to silver formate with formaldehyde and then (3) heating the silver formate to dissociate the formate radical to produce gum protected metallic silver particles.

U.S. Pat. No. 3,345,158, Block et al

Silver crystallites are formed by adding formic acid to a boiling solution of $AgNO_3$ (pH=1).

German Patent No. 2,219,531

The patent is directed to a method of making silver powder by forming a silver complex compound and reducing the compound by adding a reducing agent such as hydrazine or sodium formate. The process is carried out at a basic pH.

T. Kubota *Journal of Applied Physics* (Japan), 39(9): 861–868, 1970, "On the Control of Particle Size in Fine Silver Powders Prepared by Chemical Precipitation"

The journal article is directed to a process for making silver particles by precipitation from ammoniacal silver solutions with formaldehyde. Gelatin is added to regulate silver particle size.

DETAILED DESCRIPTION OF THE INVENTION

The process of the invention is a reductive proces in which finely divided silver particles are precipitated from an aqueous acid solution of a silver salt, gelatin and alkyl acid phosphate. The process proceeds by the following acidic reaction:

$$2AgNO_3 + NaCOOH \rightarrow 2Ag + CO_2 + NaNO_3 + HNO_3$$

Any water-soluble silver salt can be used in the process of the invention such as $Ag_3PO_4$, $Ag_2SO_4$, silver nitrate and the like. Insoluble silver salts such as AgCl are not, however, suitable. The silver salt may be used in concentrations as low as 0.2 mole/liter and upward to just below the solubility limit of the salt. It is preferred not to use concentrations below 0.2 mole/liter for the reason that the silver particles produced therefrom are too small. A concentration of 0.6 mole/liter has been found to be optimum.

The process of the invention can be carried out over a wide range of temperatures so long as the liquid phase is maintained. The process can therefore by conducted at room temperature or even below. However, the rate of reaction is slower and may not proceed to completion. Therefore, it is preferred to carry out the process at an elevated temperature on the order of at least 50° C. Though higher temperatures can be used, no significant additional benefit is obtained thereby. Consequently, a temperature range of 50°-90° C. is preferred and a temperature of 70°-80° C. is still further preferred.

Because the reactions of the process are in the liquid phase, operating pressure is not a critical variable and the process can be carried out most conveniently and economically at atmospheric pressure.

As used herein, the term "gelatin" refers to conventional animal or bone gelatin, which is an albumin derived by boiling animal tissue, bones, tendons, ligaments etc. under pressure with water. Either or both acid-extracted gelatin (A-type) or alkaline-extracted (B-type) gelatin can be used in the process of the invention. Food, technical or U.S.P. grade gelatins may be used.

The fundamental purpose of the gelatin is to assist in particle size control. Only a very small amount of gelatin is needed in the process of the invention, the amount being so small that it does not perceptibly increase the viscosity of the reaction solution. In particular, the amount of gelatin should be in the range of 0.001 to 0.02 g gelatin per g of dissolved silver ions. If less than 0.01 g gelatin is used the particle size is too large and the particle size distribution (PSD) is too broad; but if more than 0.02 g gelatin is used, the particles are too small. A gelatin concentration of 0.005 to 0.018 is preferred. Thus, gelatin concentration is one of the variables of the process which, with other process variables, can be controlled to obtain desired particulate characteristics.

Gelatin is only one of the variables of the process which are essential to obtain precise control over the particle size and PSD of the silver powders produced by the process of the invention. The alkyl acid phosphates which are needed for the practice of the invention are those which correspond to the following chemical structural formula:

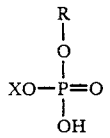

In the above formula, X is independently selected from H and R groups and R is a $C_{6-20}$ alkyl group, which optionally may contain up to 10 ethylene oxide (EO) moieties. EO moieties of no more than 4 are preferred. A wide variety of such materials is commercially available in which the ratio of R groups to H groups is varied. For example, such compounds in which the R/H ratio is 50/50 or 75/25 are available. All such materials meeting the above criteria are suitable for use in the invention so long as they can be suspended in water uniformly. It is not essential that they be completely soluble in water at the reaction conditions.

It is essential that the above-described alkyl acid phosphates be used in combination with the gelatin. For example, when the gelatin is omitted and only the alkyl acid phosphate is used in the process, the powder tends to be aggregated and the particle size distribution too wide. Furthermore, when neither gelatin nor alkyl acid phosphate is used, the resultant particles are highly agglomerated, even spongy, in character and the particle size distribution is extremely wide—$<1$ micron to $>40$ microns.

The alkyl acid phosphate is used in the process of the invention at a concentration of at least 0.05 gram/liter in order to be effective. Higher concentrations can be used; however, concentrations above about 1.0 gram/liter do not present any further advantage. A concentration of 0.1-0.5 gram/liter is preferred.

As the reducing agent for the process of the invention, any water-soluble formate can be used such as sodium formate, potassium formate or ammonium formate. The amount of formate to be used must be stoichiometrically sufficient to reduce all of the silver cations in the reaction solution and preferably in molar excess to assure removal of all the silver in the reaction solution. A molar excess of at least 0.1 mole/mole is preferred and 0.50 is still further preferred. Though still higher excesses of formate can be used in the process, they serve no technical advantage. In order to minimize the foaming tendcency of the reaction solution, it is preferred to add the formate slowly in a continuous or intermittent manner. In general, slower formate feed rates result in the formation of larger silver particles. Thus, the formate feed rate should be sufficiently slow to avoid foaming, yet sufficiently fast to obtain small sized particles.

The process of the invention is carried out at non-basic conditions in order to obtain a lower reaction rate and better control over the reaction rate. Basic processes for the precipitation of silver are not preferred for the reason that the resultant silver particles are too small and silver oxide ($Ag_2O$) is formed as an intermediate of limited solubility. On the other hand, in the process of the invention, all reactant species are soluble.

It is unnecessary to adjust the pH of the invention process since the presence of alkyl acid phosphate and silver nitrate render the initial reaction solution acidic and the evolution of carbon dioxide and nitric acid during the process keep the reaction solution in the acid state.

While carrying out the process, it is necessary to keep the precipitated silver particles dispersed in the reaction solution in order to provide spatially homogeneous particle growth conditions and thus to prevent widening of the particle size distribution. This is done by agitating the reaction solution. However, because of the tendency of the reaction solution to foam due to the presence of the surface-active alkyl acid phosphates, it is necessary to keep the degree of agitation low enough to prevent substantial foaming.

Upon completion of the precipitation reaction, the particles are separated from the reaction solution, washed to remove ionic species adsorbed on the particles and then dried.

The particles can be separated from the reaction solution by conventional process such as decantation, filtration, centrifugation and the like. The particles with most of the water removed therefrom are then washed with water, preferably deionized water, to remove adsorbed ionic species on the particles. This is done by repeatedly washing the particles in water until the electrical conductivity of the wash solution is below about 20 microsiemens. (One microsiemen is equivalent to one micromho.) Following the washing step, the washed particles are then dried by such techniques as oven drying, freeze drying, vacuum drying, air drying and the like and combinations of such techniques.

EXAMPLES

General Procedure

Disperse and dissolve phosphate surfactant in deionized (DI) water in an 8-liter glass reaction vessel with baffles and a marine propeller-type agitator. Dissolve the gelatin at 50° C. Heat the solution to 80° C. and dissolve the $AgNO_3$ to specified concentration. In a separate vessel prepare the formate solution in the specified concentration at 80° C. Start feeding the solution into the reaction vessel at the feed rate specified for a specified time period with sufficient agitator speed to suspend the solid product uniformly in the liquid medium.

At the completion of the feeding period, hold the suspension at 80° C. with the same agitation velocity for 30 minutes. Stop heat and agitation. Filter and wash the product solids with deionized (DI) water to 10 micromho conductivity. Freeze dry.

A series of 20 batches of silver particles was prepared by the foregoing procedure to observe the effect of process variables on the properties of precipitated silver particles. The data for these 20 batches are given in Table 1 below.

TABLE 1

Effect of Process Variables on Silver Particle Properties

| Ex. No. | [Ag+] (mol/L) | [HCOO-] (mol/L) % (w/wAg) | Gelatin conc. Type | Phosph(5) Surfac % (w/V) | Phosph Surfac | Feed Rate(3) (mins) | Feed Time | Mole Ratio | SA(1) (m2/g) | PSD(2) Min (micr) | PSD(2) Max (micr) | Aggre-(6) gated | Remark |
|---|---|---|---|---|---|---|---|---|---|---|---|---|---|
| 1 | 0.58 | 3.25 | 1.60 | TDP | 0.03 | 0.0083 | 120 | 1.0 | 2.1 | 0.1 | 0.4 | N | |
| 2 | 0.29 | 2.25 | 1.60 | TDP | 0.03 | 0.0083 | 120 | 1.0 | 2.2 | 0.1 | 0.3 | N | |
| 3 | 0.87 | 5.83 | 1.40 | TDP | 0.03 | 0.0220<br>0.0110 | 10<br>160 | 2.0 | 1.5 | 0.1 | 0.5 | Y | varied feed |
| 4 | 0.58 | 3.25 | 1.60 | TDP | 0.03 | 0.0059<br>0.0120 | 60<br>90 | 1.4 | 1.9 | 0.1 | 0.4 | N | varied feed |
| 5 | 0.58 | 3.25 | 0.16 | TDP | 0.01 | 0.0083 | 120 | 1.0 | 1.0 | 0.2 | 0.8 | N | |
| 6 | 0.58 | 3.25 | 0.80 | TDP | 0.03 | 0.0083 | 120 | 1.0 | 1.9 | 0.1 | 0.5 | N | |
| 7 | 0.58 | 3.25 | 0.00 | TDP | 0.03 | 0.0083 | 120 | 1.0 | 0.6 | 0.1 | 1.5 | Y | phosphate only |
| 8 | 0.58 | 3.25 | 0.00 | None | 0.00 | 0.0083 | 120 | 1.0 | 0.1 | 1.5 | 15+ | Y/V | no gelatin or phosphate |
| 9 | 0.58 | 3.25 | 1.60 | None | 0.00 | 0.0083 | 120 | 1.0 | 3.6 | <<0.1 | 0.1 | Y/V | gelatin only |
| 10 | 0.58 | 3.25 | 0.80 | None | 0.00 | 0.0083 | 120 | 1.0 | 0.9 | <0.0 | 0.6 | Y/V | gelatin only |
| 11 | 0.58 | 3.25 | 0.40 | TDP | 0.01 | 0.0083 | 120 | 1.0 | 1.3 | 0.1 | 0.7 | N | |
| 12 | 0.58 | 3.25 | 0.20<br>0.40 | TDP | 0.01 | 0.0083 | 90<br>120 | 1.0 | 1.4 | 0.1 | 0.5 | N | gel. added in two steps |
| 13 | 0.58 | 3.25 | 0.16 | None | 0.00 | 0.0083 | 120 | 1.0 | 0.4 | <0.1 | 2–3 | Y/V | gel. only (minimum) |
| 14 | 0.58 | 3.25 | 0.80 | TDP | 0.03 | 0.0083 | 120 | 1.0 | 2.1 | 0.1 | 0.4 | N | S.S. reaction vessel(4) |
| 15 | 0.58 | 3.25 | 0.80 | PS-121 | 0.03 | 0.0083 | 120 | 1.0 | 1.6 | 0.1 | 0.7 | N | S.S. reaction vessel(4) |
| 16 | 0.58 | 3.25 | 0.80 | PS-900 | 0.03 | 0.0083 | 120 | 1.0 | 2.1 | 0.1 | 0.4 | N | S.S. reaction vessel(4) |
| 17 | 0.58 | 3.25 | 0.80 | PS-400 | 0.03 | 0.0083 | 120 | 1.0 | 2.7 | 0.1 | 0.25 | N | S.S. reaction vessel(4) |
| 18 | 0.58 | 3.25 | 1.60 | None | 0.00 | 0.0083 | 120 | 1.0 | 6.6 | <<0.1 | 0.1 | N | gel. fed in formate |
| 19 | 0.58 | 3.25 | 0.80 | PS-900 | 0.03 | 0.0184 | 55 | 1.0 | 2.2 | 0.1 | 0.4 | N | high feed rate |
| 20 | 0.58 | 3.25 | 0.80 | PS-900 | 0.03 | 0.0037 | 270 | 1.0 | 1.7 | 0.1 | 0.6 | N | low feed rate |

(1)By single point B.E.T. method using Flowsorb II, Model 2300 by Micromeritics.
(2)By measurement of particles in SEM photos at 10,000x.
(3)Moles formate/minute/total moles silver in the system.
(4)Examples 14–20.
(5)TDP is tridecylphosphate.
(6)N: No; Y: Yes; Y/V: yes, very aggregated.

Columns 2–9 are from direct observations or calculations. SA, surface area, in column 10 is by BET measurements. The minimum and the maximum of the particle size distribution (PSD) in cols. 11 and 12 were estimated by direct measurements on SEM photomicrographs. Column 13 indicates whether the powder appears agglomerated or fused together in the SEM photos in the freeze-dried state.

EXAMPLE 1

Base case against which the other cases are compared unless otherwise specified. The product powder was spherical with a fairly uniform PSD which lies between 0.1 to 0.4 micrometer. The powder does not appear agglomerated in SEMs. SA is 2.1 $m^2/g$.

EXAMPLE 2

Shows that reducing reagent concentrations by 50% and 30% respectively, results in a very slight decrease in size; and consequently, slight increase in SA. Probably attributable to the fact that smaller amount of the limiting reagent ($AgNO_3$) was available.

EXAMPLE 3

Shows that increasing reagent concentrations by 50% and 80%, respectively, and employing a two-stage feeding schedule where the formate is fed at 2.6× the feed rate of the base case for 10 mins and then at 1.3× for 160 mins results in a powder of somewhat fused particles with irregular shapes and a lower surface area.

EXAMPLE 4

Shows that feeding at 70% of the base rate for 60 mins followed by 140% of the base rate for 90 mins results in a powder that is essentially identical to the base case.

EXAMPLE 5

Shows that using 1/10 the concentration of gelatin and ⅓ the concentration of the phosphate surfactant (TDP) as the base case results in a powder with broader PSD, and only half the SA, i.e. larger mean particle diameter.

EXAMPLE 6

Shows that using ½ the conc. of gelatin and the same conc. of TDP as the base case results in a slightly larger PSD and slightly smaller SA.

EXAMPLE 7

Shows that using no gelatin while keeping TDP conc. same as the base case results in a much broader PSD and much lower SA, while the powder appears agglomerated in SEMs.

EXAMPLE 8

Shows that using no gelatin and no phosphate surfactant results in a very broad PSD and a very small SA with highly fused or agglomerated powder.

EXAMPLE 9

Shows that using the base conc. of gelatin and no phosphate results in a powder with very small particles which appear to be highly agglomerated.

EXAMPLE 10

Shows that reducing the gelatin conc. to one half while still using no phosphate results in a fairly broad PSD and a highly agglomerated powder.

EXAMPLE 11

Similar to Example 5, except employing ¼ of the base gelatin conc., as opposed to 1/10, at ⅓ the base TDP conc. A powder with SA and PSD spread between Example 5 and Example 1 is produced.

EXAMPLE 12

Similar to Example 11, except gelatin is added in two equal installments at 0 and 90 mins. A somewhat smaller and more uniform (narrower PSD) powder is produced.

EXAMPLE 13

To be compared to Examples 5, 9, and 10. Shows that using no phosphate (as in Examples 9 and 10) at 1/10 the gelatin conc. of the base case (as in Example 5) results in a very broad PSD (much broader than Example 5) and a low SA (0.4 vs 1.0 of Example 5). Also, the powder is quite agglomerated.

EXAMPLE 14

Similar to Example 6, except a stainless steel reaction vessel is used instead of the glass one. A product of very nearly the same properties as Example 6 is produced. Examples 15–20 below all had the same s.s. vessel and therefore should be compared to this case.

EXAMPLE 15

Similar to Example 14, except using alternate phosphate surfactant PS-121 (Witco) with an ethoxylated structure. A broader PSD and lower SA (1.6 vs 2.1 $m^2/g$) powder was produced.

EXAMPLE 16

Similar to Example 14, except using alternate phosphate PS-900 (Witco) which is very similar to TDP (R=C13) Product powder is virtually identical to that of Example 14.

EXAMPLE 17

Similar to Example 14, except using alternate phosphate PS-400 (Witco) with R=C8. A smaller size, higher SA (2.7 vs 2.1), and broader PSD powder is produced.

EXAMPLE 18

Similar to Example 9 where the base conc. of gelatin was used with no phosphate. However, here the gelatin is dissolved in the formate feed solution and is fed into the reaction vessel gradually with the formate. A very fine but not agglomerated powder is produced as opposed to the highly agglomerated appearance of the Example 9 powder.

EXAMPLE 19

Similar to Example 16, except feed rate is 2.2× (with shorter feed time). The powder is very slightly smaller than Example 16 (SA=2.2 $m^2/g$ vs 2.1) indicating a very small effect due to higher feed rate.

EXAMPLE 20

Similar to Example 16, except feed rate is 1/2.25 (44%) that of Example 16 with longer feed time (270 mins vs 120). The powder is slightly larger in mean diameter (SA=1.7 $m^2/g$ vs 2.1) and has a slightly broader spread of PSD than Example 16 indicating a small effect due to lower feed rate.

We claim:

1. A process for the preparation of finely divided particles of metallic silver comprising the sequential steps:

A. Forming a non-basic aqueous solution of a silver salt, a gelatin and an alkyl acid phosphate corresponding to the structural formula:

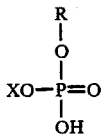

wherein X is independently selected from H and R groups and R is a $C_{6-20}$ alkyl group, which optionally may contain up to 10 ethylene oxide (EO) moieties, the solution comprising at least 0.2 mole per liter of dissolved silver salt, from 0.001 to 0.02 grams of gelatin per gram of metallic and from 0.1 to 0.5 gram of alkyl acid phosphate per liter of initial solution;

B. Admixing into the reactant solution from step A. a stoichiometric excess of a water-soluble formate to effect complete reduction of the silver salt by which discrete particles of metallic silver are precipitated with the concomitant formation of $CO_2$ and $HNO_3$, while maintaining the reaction solution under agitation at a rate sufficient to keep the precipitated particles dispersed until the reduction reaction is completed, but sufficiently low to avoid foaming of the reaction dispersion;

C. Separating the silver particles from the liquid components of the reaction solution;

D. Washing the separated silver particles with deionized water to remove adsorbed materials therefrom; and E. Drying the washed silver particles to remove the water therefrom, wherein the silver particle size distribution is within the range of 0.1 micrometers to 1.0 micrometers.

2. The process of claim 1 in which the water-soluble formate is selected from group consisting of $Na^+$, $K^+$ and $NH_4^+$ formates and mixtures thereof.

3. The process of claim 1 in which the reduction reaction is carried out at 60–90C.

4. The process of claim 1 in which the alkyl acid phosphate is tridecyl acid phosphate in which the alkyl chain is ethoxylated with a chain of four ethylene oxide groups.

5. The process of claim 1 in which 40–80% of the X groups of the alkyl acid phosphate are R and 60–20% are H groups.

6. The process of claim 5 in which 50% of the X groups are R and 50% are H.

7. The process of claim 5 in which 75% of the X groups are R and 25% are H.

8. The process of claim 1 in which the R group is $C_{8-15}$ alkyl.

9. The process of claim 8 in which the R group is $C_{13}$ alkyl.

* * * * *